United States Patent [19]

MacAskill, Jr. et al.

[11] 3,938,939

[45] Feb. 17, 1976

[54] BURNER CONTROL SYSTEM WITH SECONDARY SAFETY SWITCH

[75] Inventors: Robert Bruce MacAskill, Jr.; Charles Norvin Porter, both of Rockford, Ill.

[73] Assignee: Sundstrand Corporation, Rockford, Ill.

[22] Filed: Feb. 12, 1975

[21] Appl. No.: 549,409

[52] U.S. Cl. ..... 431/79; 431/69

[51] Int. Cl.[2] ..... F23N 5/08

[58] Field of Search ..... 431/78, 79, 75, 69, 71, 431/74

[56] References Cited

UNITED STATES PATENTS

| | | | |
|---|---|---|---|
| 3,425,780 | 2/1969 | Potts | 431/71 X |
| 3,732,433 | 5/1973 | Lourigan | 431/74 X |
| 3,816,053 | 6/1974 | Cade | 431/78 |
| 3,829,276 | 8/1974 | Lenski et al. | 431/79 X |

*Primary Examiner*—Edward G. Favors
*Attorney, Agent, or Firm*—Ted E. Killingsworth; Michael B. McMurry

[57] ABSTRACT

The primary side of the burner control circuit, which has as its primary function the application of a line voltage to the burner motor and igniter, includes: a triac switch for applying the line voltage to the burner motor and igniter; in response to a first optical coupler; a circuit breaker switch for disconnecting the primary from the line voltage; and a light source for a second optical coupler. The secondary side of the burner control circuit, which is responsive to a thermostat, includes: a light sensitive element for detecting a flame at the burner; a light source for the first optical coupler; and a current responsive element which in combination with the circuit breaking switch in the primary functions as a circuit breaker. The first optical coupler responds to the thermostat to cause the triac switch to connect the motor and igniter to the line voltage and, if a flame is not sensed within a predetermined time by the light sensitive element, the circuit breaker will disconnect the motor from the line voltage. In addition, the second optical coupler serves as a safety device to disconnect the motor from the line voltage by means of the circuit breaker whenever the triac is in a shorted condition and the thermostat is not calling for heat.

14 Claims, 1 Drawing Figure

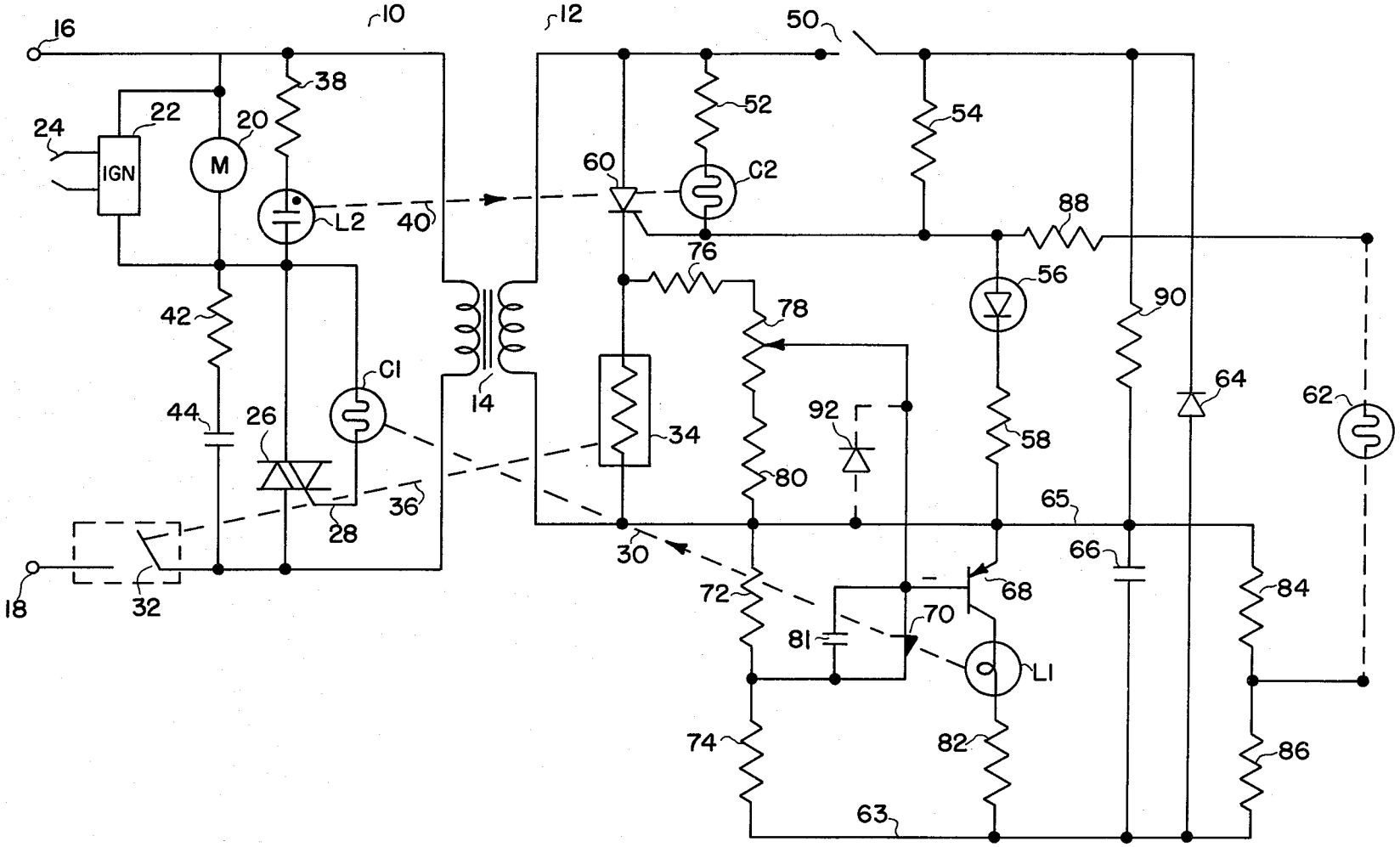
IGN
M
L1
L2
C1
C2

BURNER CONTROL SYSTEM WITH SECONDARY SAFETY SWITCH

BACKGROUND OF THE INVENTION

The invention relates to the field of oil burner control systems and more particularly to electronic control circuits having fail safe capabilities with a circuit breaker activated by the secondary of the control circuit.

In prior art systems, specifically represented by: Lenski, U.S. Pat. No. 3,770,365; the application of Lenski entitled, "Burner Control" Ser. No. 362,387 filed on May 21, 1973; and the application of MacAskill entitled "Burner Control System With Primary Safety Switch," which are all assigned to the assignee of this application, utilize either an electromechanical safety switch in the secondary portion of the control circuit for the purpose of disconnecting the burner motor when, after call for heat by the thermostat, a flame is not detected at the burner within certain time limits; or, in the MacAskill application, utilize a safety switch in the primary of the burner control circuit for the above purpose in addition to disconnecting the motor in the event the triac controlling the application to the line voltage to the motor should become shorted. The application of MacAskill also uses an electronic timing circuit in the secondary for governing the time between a call for heat by the thermostat and the switching off of the burner due to a failure to detect a flame at the burner.

Although the application of MacAskill provided substantial improvements over the other systems, the utilization of the electronic timing circuitry, however, tended to add complexity and cost to the burner control system.

SUMMARY OF THE INVENTION

It is, therefore, an object of the invention to provide a burner control system with a fail safe capability with the controlling element of the circuit breaker located in the secondary of the control circuit.

It is another object of the invention to provide a safety circuit for use in a burner control system wherein the control element of the circuit breaker is located in the secondary circuit performs general timing functions along with causing the circuit breaker switch to disconnect the primary from the line voltage.

It is a further object of the invention to provide a burner control system having a triac controlled burner with a circuit breaker activated by the secondary of the circuit in order to compensate for a shorted triac.

An additional object of the invention is to provide a burner control system wherein the motor is activated by a triac which is manually operable when the triac is shorted.

The burner control circuit is comprised of two major portions; a primary connected to a line voltage which has as its basic function the application of the line voltage to the burner motor and the igniter, and a secondary circuit that is responsive to both a thermostat and a light sensitive element for detecting a flame in the burner. The primary circuit includes a triac switching device, responsive to signals from the secondary for connecting the motor and igniter to line voltage. In addition, the primary contains a switch that is responsive to a current sensitive element contained in the secondary, for causing the primary circuit to open at a predetermined time after current has begun to flow through a current sensitive element. The primary also includes a light source, for example a neon tube, which is optically coupled to a light sensitive element in the secondary.

The secondary, in response to a signal from the thermostat representing a call for heat, turns on the light generating source of the first optical coupler thereby having the effect of connecting the burner motor and igniter to the line voltage. The closing of the thermostat contact also closes a second switch, for example, an SCR, that permits current to flow through the current sensitive element of the circuit breaker. The current will continue to flow through the current sensitive element until the flame detecting cell senses a flame at the burner thus causing the second switch to turn off and preventing the circuit breaker from opening and disconnecting the line voltage. However, if the flame is not detected within the predetermined time, the circuit breaker will disconnect the motor from the line voltage.

During normal operation, when the thermostat contacts open as a result of a termination of a call for heat, the first optical coupler will turn off the triac thus disconnecting the motor and igniter from the line voltage. In the event the flame should go out during a call for heat, the flame cell will cause the second switch to allow current to again pass through the heating element of the circuit breaker. If a flame is not reestablished within the time it takes the circuit breaker to time out, the circuit breaker switch in the primary will disconnect the motor from the line voltage.

The burner control circuit also includes a second optical coupler with its light source in the primary, responsive to the application of the line voltage across the motor, and its light sensitive resistance in the secondary which, in cooperation with the flame detecting cell, serves to turn on the second switch. In the event the triac that connects the motor to the line voltage should become shorted, thus preventing the motor from being shut off when there is no longer a call for heat, the combination of the thermostat opening with the reduced resistance in the second optical coupler will cause the second switch to close thereby permitting current to flow through the current responsive element of the circuit breaker. This safety feature will have the effect of disconnecting the line voltage from the motor when the thermostat is open and the triac has shorted. This system has an additional advantage in that by resetting the circuit breaker, when there is a call for heat, the burner control system will function in a normal manner thereby allowing for manual operation of the heating system even with a shorted triac. That is, the burner motor and igniter will continue to function until the temperature causes the thermostat to open which in turn will cause the circuit breaker to again trip out.

BRIEF DESCRIPTION OF THE DRAWING

FIG. 1 is a schematic diagram of the burner control circuit.

DETAILED DESCRIPTION OF THE INVENTION

The preferred embodiment of the invention is illustrated in FIG. 1 and is composed of a burner control circuit having a primary side 10 and a secondary side 12. The primary 10 is operatively coupled to the secondary 12 by means of a transformer 14. The primary 10 is connected across a line voltage, typically 115–120 volts AC, by means of terminals 16 and 18. Associated with the primary are a burner motor 20 and an igniter 22. The function of the motor 20 is to atomize the fuel oil and force it through the spark gap 24 of the igniter 22, thus causing the ignition of the fuel oil. Controlling the application of the line voltage across the motor 20 and igniter 22 is a switch 26 which, in the preferred embodiment, is a triac type device. The triac 26 responds to a reduced electrical resistance in a light sensitive element C1 that is connected by line 28 to the gate of the triac 26. Light sensitive element C1 forms a portion of an optical coupler L1-C1 having its light source L1 located in the secondary 12 and where the operative relationship is indicated by the dashed line 30. When a light is applied to light sensitive element C1 from the light source L1 of the optical coupler, its electrical resistance is substantially reduced thus allowing a voltage to be applied to the gate of the triac 26. This will serve to switch on the triac 26 resulting in the line voltage being applied across both the motor 20 and igniter 22. In the preferred embodiment of the invention the triac 26 is controlled by the optical coupler L1-C1 but it is apparent that this essentially relay type function could be accomplished by a wide variety of relay elements including an electromechanical relay.

In addition to the triac 26, the primary 10 contains a circuit breaking switch 32 which in turn is controlled by a heat or current sensitive element 34 in the secondary 12. This control relationship is indicated by the dashed line 36. The combination of the current sensitive element 34 and the switch 32 is equivalent to, and can be implemented by a wide variety of commercially available circuit breakers. As is typical of current sensitive circuit breakers, when current flows through the current or heat sensitive element 34, it will gradually heat the element until it reaches a predetermined temperature whereupon it will cause the switch 32 to open. A second optical coupler, L2-C2, forms another portion of the burner control circuit and again performs essentially a relay type function. The light generating element L2 is connected in parallel with the motor 20 and igniter 22 as well as being in series with the triac 26. In the preferred embodiment of the invention the light source L2 is a neon lamp that will generate light whenever the triac 26 is turned on and the line voltage is applied to the primary 10. Light sensitive element C2 forms a portion of the secondary 12 and its operative relationship with L2 is indicated by the dashed line 40. The primary 10 also includes a resistor 42 and a capacitor 44 which are connected in parallel with the triac 26 forming a "snubber circuit" in order to prevent the switching of the triac 26 due to turn-on and turn-off voltage transients.

The secondary of the transformer 14 provides the secondary side 12 of the circuit with, in the preferred embodiment, approximately 12 volts AC. Responding to a call for heat, the contacts of a thermostat 50 will close, thereby serving to energize the secondary 12 of the circuit. Prior to the closing of the thermostat contacts 50, current will not be able to flow through a resistor 52 and the light sensitive element C2 due to the fact that the resistance of element C2 will be very high. At this point, it will be remembered, that triac 26 will be in a non-current conducting state and the light source L2 will be off.

Upon the closing of the thermostat contacts 50, current will flow through a resistor 54, a light emitting diode 56 and a resistor 58. This current flow will serve to apply a voltage to the gate of an electronic switch 60 which in the preferred embodiment is a silicon controlled rectifier or SCR. This voltage applied to the gate of SCR 60 will be sufficiently positive to turn on the SCR thus allowing current to flow through the current sensitive element 34 of the circuit breaker.

Also included in the secondary side is the flame sensitive element 62, which is preferably a light sensitive cadmium photo resistive cell located adjacent to the burner (not shown), so that the cell 62 is responsive to the presence or absence of a flame at the burner. The flame cell 62 is shown with dashed lines because it is normally not included in the same physical package as the rest of the circuit. Normally flame cell 62 will have a very high resistance until a flame is present in the burner whereupon the electrical resistance will drop to a very low value. When this occurs an alternate current path will in effect be opened so that the positive voltage previously applied to the gate of SCR 60 will be in effect removed, thus turning off the SCR 60.

The secondary 12 further includes a diode 64 and a capacitor 66 that cooperate, when thermostat contact 50 are closed, to establish a negative DC potential between lines 63 and 65. The cathode of an asymmetrical switch 70 is connected to this negative DC potential by means of the voltage divider 72 and 74. During normal operation, just after the thermostat contacts are closed but before a flame is detected by the flame cell 62, the SCR 60 will permit current to flow through current sensitive element 34 and through resistors 76, 78, and 80. A portion of the positive voltage developed across current sensitive element 34 is applied to the anode of the asymmetrical switching diode 70 through a resistor 76 and an adjustable resistance 78. This positive voltage will cause the diode 70 to break over the latch in a current conducting state thus serving to turn on transistor 68. A capacitor 81 prevents the diode 70 from being triggered by noise in the circuit. The transistor 68 is in a current conducting state, current will flow from the transistor 68 to the resistor 82 and through the light generating element L1 resulting in a decrease of resistance of C1 and the application of the line voltage to the motor 20 and the igniter 22. If for some reason a flame is not present or detected by the flame cell 62 within a predetermined amount of time, the current sensitive element 34 as previously explained will cause the circuit breaking switch 32 to open, thus disconnecting the motor 20 and igniter 22 from the line voltage.

An additional safety feature is provided by the adjustable resistance 78 since a low line voltage, transmitted through the transformer 14 and resistor 78, will prevent the diode 70 from latching. This will prevent the starting of the motor 20 and the igniter 22 whenever the line voltage is too low for the safe operation of this equipment.

An additional safety factor is provided to compensate for a short in the flame detecting cadmium cell 62 at the time the thermostat contacts 50 are closed. The resistors 84 and 86 form a voltage divider that is effective to apply negative voltage through the shorted flame detector cell 62 to the gate of the SCR 60 thereby preventing the activation of the system. The diode 64 and capacitor 66 produce approximately a negative 12 volts on line 63. In addition, a resistor 88 is placed in circuit between the flame detecting cell 62 and the SCR 60 in order to prevent excessive current from being applied to the gate of the SCR 60 in the event of a dead short across the flame detecting cell 62. Resistor 90, is placed in the circuit when thermostat contacts 50 close in order to provide for sufficient current flow through the thermostat, along with the current flowing through resistor 54, to ensure proper operation of the thermostat's anticipator circuitry.

Another very important feature of the burner control circuit of FIG. 1 is the fail safe capability that is implemented with the aid of the optical coupler L2-C2. This fail safe capability is most useful in the event that in this embodiment triac 26 should short in a current conducting state thereby preventing the motor or igniter from turning off when the thermostat 50 is opened. In the event this condition should occur, there will be enough current flowing through the neon lamp L2 to have the effect of lowering the resistance in the light sensitive element C2. With the opening of the thermostat contacts 50 and the low resistance in C2, a sufficiently positive voltage will be applied to the gate of the SCR 60 to turn it on. This will result in the current sensitive element 34 eventually timing out and opening the circuit breaking switch 32 thus preventing damage to the burner system as a whole. Another particularly useful aspect of this arrangement concerns the fact that it is possible to utilize the burner control system even when triac 26 is in a permanently shorted condition. For example, if parts or a properly qualified serviceperson are not available, it is possible for the owner to utilize his burner control system in a manual fashion simply be resetting the circuit breaker whenever the temperature drops below the desired level. Resetting the circuit breaker when thermostat contacts 50 are closed will cause the burner and motor to operate in a normal manner until the thermostat contacts open indicating that the desired temperature has been reached.

Another feature of the circuitry shown in FIG. 1, that is of interest, concerns the dual use made of transistor 68. Normally in order to bias the asymmetrical diode 70, commercially identified as an ST-4, in a latched on state, it would be necessary to provide a current source from the junction of resistors 72 and 80. This requirement is illustrated by the diode 92 connected to the circuit by means of the dashed lines. However, by using a transistor 68 having PNP characteristics, the current flow through the emitter to the base will act as a diode supplying the asymmetrical switch 70 with the identical latching function thereby eliminating the need for a separate source of current such as the diode 92.

We claim:

1. A burner control system having: a primary circuit including a switch for connecting the burner motor to a line voltage and a secondary circuit responsive to a thermostat and a flame detecting means, comprising:

circuit breaker means for disconnecting the burner motor from the line voltage wherein said circuit breaker means includes: a current sensitive element in the secondary; and a fail safe means for activating said circuit breaker means in the event the switch for connecting the line voltage to the burner should fail.

2. The system of claim 1 wherein said circuit breaker means includes a circuit breaker switch in the primary, responsive to said current sensitive element, for disconnecting the primary from the line voltage.

3. The system of claim 2 wherein the switch for connecting the burner motor to the line voltage is activated from the secondary by a first relay means.

4. The system of claim 3 wherein the switch for connecting the burner motor to the line voltage is a triac and said relay means is an optical coupler having its light generating source in the secondary.

5. The system of claim 1 wherein said fail safe means includes:

a second relay means for indicating to the secondary that the line voltage is being applied to the burner motor; and a switch means in the secondary and responsive to both said second relay means and the thermostat for applying a current to said current sensitive element.

6. The system of claim 5 wherein said second relay means is an optical coupler with its light generating element connected in parallel to the burner motor and in series with the switch for connecting the burner motor to the line voltage.

7. The system of claim 6 wherein said switch means in the secondary is an electronic switch having a gate responsive to the thermostat, the flame detecting means and said optical coupler, for applying current to said current sensitive element when the thermostat is open and voltage is being applied to the burner motor.

8. The system of claim 7 wherein said circuit breaker means includes:

a circuit breaker switch in the primary responsive to said current sensitive element; and a first relay means comprised of an optical coupler for activating the switch connecting the burner motor to the line voltage wherein said optical coupler has its light generating source in the secondary and wherein said light generating source is responsive to the thermostat.

9. The system of claim 8 wherein:

the switch for connecting the line voltage to the burner motor is a triac having its gate connected to said first optical coupler;

said second optical coupler's light generating element is a neon tube; and said electronic switch is a silicon controlled rectifier.

10. A burner control circuit responsive to a thermostat comprising:

a primary circuit connected across a line voltage including: an electronic switch for connecting a burner motor to the line voltage, a circuit breaker switch, a light responsive element for a first optical coupler, and a light generating source for a second optical coupler; and a secondary circuit including: a flame detecting cell, a light source for said first optical coupler operatively responsive to the thermostat, a light responsive element for said second optical coupler, a current sensitive element operatively connected to said circuit breaking switch, and an electronic switch operatively connected to the thermostat, said flame detecting cell and said light responsive element of said second optical coupler for admitting current to said current sensitive element.

11. The circuit of claim 10 wherein said electronic switch in said primary is a triac having its gate connected to said light responsive element of said first optical coupler.

12. The circuit of claim 11 wherein said electronic switch in said secondary is a silicon controlled rectifier having its gate operatively connected to the thermostat and said light responsive element of said second optical coupler.

13. The circuit of claim 12 wherein said light source of said first optical coupler is controlled by a circuit that includes:

a PNP transistor operatively connected to said light source;

an asymmetrical diode responsive to current flow through said current sensitive element for switching on said transistor, wherein the diode characteristics of said PNP transistor maintain said diode in a latched state.

14. A transistor circuit comprising:

a first source of current;

a second source of current;

an asymmetrical diode responsive to said first source wherein said diode will conduct current in response to a current applied by said first source;

a PNP transistor having its emitter connected to said second source and its base connected to said diode, effective to maintain said diode in a current conducting state and therefore said transistor in a current conducting state after said first source has been switched off.

* * * * *